US011326241B2

(12) United States Patent
Huang et al.

(10) Patent No.: US 11,326,241 B2
(45) Date of Patent: May 10, 2022

(54) PLASTIC WROUGHT MAGNESIUM ALLOY AND PREPARATION METHOD THEREOF

(71) Applicant: CITIC Dicastal CO., LTD., Hebei (CN)

(72) Inventors: Lixin Huang, Qinhuangdao (CN); Zuo Xu, Qinhuangdao (CN); Chunhai Liu, Qinhuangdao (CN); Zhihua Zhu, Qinhuangdao (CN); Lisheng Wang, Qinhuangdao (CN); Yongfei Li, Qinhuangdao (CN); Dong Guo, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 243 days.

(21) Appl. No.: 16/508,327

(22) Filed: Jul. 11, 2019

(65) Prior Publication Data

US 2020/0149143 A1 May 14, 2020

(30) Foreign Application Priority Data

Nov. 8, 2018 (CN) ..... 201811321992.2

(51) Int. Cl.

| | |
|---|---|
| ***C22F 1/06*** | (2006.01) |
| ***B22D 15/00*** | (2006.01) |
| ***C22C 1/02*** | (2006.01) |
| ***C22C 23/02*** | (2006.01) |

(52) U.S. Cl.

CPC ..... *C22F 1/06* (2013.01); *B22D 15/00* (2013.01); *C22C 1/02* (2013.01); *C22C 23/02* (2013.01)

(58) Field of Classification Search

None

See application file for complete search history.

(56) References Cited

U.S. PATENT DOCUMENTS

| | | | | |
|---|---|---|---|---|
| 3,653,880 | A | 4/1972 | Gitlesen | |
| 2008/0311423 | A1 | 12/2008 | Numano | |
| 2009/0035171 | A1* | 2/2009 | Kawamura | B21C 23/002 420/404 |
| 2011/0033332 | A1 | 2/2011 | Numano et al. | |
| 2015/0000800 | A1 | 1/2015 | Pan et al. | |
| 2019/0368010 | A1 | 12/2019 | Chae et al. | |

FOREIGN PATENT DOCUMENTS

| | | | |
|---|---|---|---|
| CN | 101435046 | A | 5/2009 |
| CN | 101572851 | A | 11/2009 |
| CN | 101705404 | A | 5/2010 |
| CN | 102803534 | A | 11/2012 |

(Continued)

OTHER PUBLICATIONS

European Search Report in the European application No. 19201498.3, dated Jan. 8, 2020.

(Continued)

*Primary Examiner* — Brian D Walck

(74) *Attorney, Agent, or Firm* — Syncoda LLC; Feng Ma

(57) ABSTRACT

A plastic wrought magnesium alloy includes a Mg—Al—Bi—Sn—Ca—Y alloy, prepared from the following chemical components in percentage by mass: 3 to 6.0% of Al, 1 to 3.0% of Bi, 0.5 to 2.0% of Sn, 0.02 to 0.05% of Ca, 0.02 to 0.05% of Y and the balance of Mg, in which the percentage sum of Ca and Y elements is more than 0.05% and less than 0.1%.

8 Claims, 6 Drawing Sheets

(56) References Cited

FOREIGN PATENT DOCUMENTS

| | | | |
|---|---|---|---|
| CN | 103160721 | A | 6/2013 |
| CN | 104233030 | A | 12/2014 |
| CN | 105132772 | A | 12/2015 |
| CN | 105154734 | A | 12/2015 |
| CN | 106591843 | A | 4/2017 |
| CN | 108220725 | A | 6/2018 |
| CN | 109252079 | A | 1/2019 |
| EP | 3561098 | A1 | 10/2019 |
| GB | 596102 | A | 12/1947 |
| JP | 2012143811 | A | 8/2012 |
| WO | 2016193974 | A1 | 12/2016 |

OTHER PUBLICATIONS

Zhu Can: "Study on Microstructures and Properties ofMg—Al—Sn—Y Alloys"; China Excellent Master thesis Full-text Database Engineering Science and Technology I; May 2016.

* cited by examiner

PLASTIC WROUGHT MAGNESIUM ALLOY AND PREPARATION METHOD THEREOF

CROSS-REFERENCE TO RELATED APPLICATIONS

This application claims priority to Chinese Patent Application No. 201811321992.2 filed on Nov. 8, 2018, the disclosure of which is hereby incorporated by reference in its entirety.

BACKGROUND

It is well known that magnesium has a density of about 1.74 g/cm$^3$, which is ⅔ of that of aluminum and ¼ of that of steel. In many metals, a magnesium alloy is the lightest metal structural material available to date. It has the advantages of high specific strength and specific stiffness, good cushioning property, high electromagnetic shielding performance and radiation resistance, ease of cutting processing, environmental-friendly recycling and the like and has broad application prospects in the fields of automobiles, electronics, electrical appliances, transportation, aerospace, etc. The magnesium alloy is a lightweight metal structural material developed after the development of steel and aluminum alloy, and also may be developed as a biomedical material and functional materials such as an air battery, and is known as a 21st century environmental-friendly engineering material.

However, due to its close-packed hexagonal crystal structure, magnesium is not as good as a face-centered cubic or body-centered cubic mechanism slip system at a temperature lower than 200° C., and therefore the plasticity is generally poor. Therefore, it is generally necessary to process the magnesium to deform at a relatively high temperature. However, increasing the processing temperature not only makes it easier to roughen grains, but also reduces the overall mechanical properties of the material, and further increases the processing cost. Therefore, development of magnesium alloy materials with excellent plasticity at a room temperature or relatively low temperature may greatly promote the wide application of the magnesium and its alloys in the fields of automobiles, rail transit, aviation, etc., and has important practical significance for expanding the application fields of the magnesium alloys.

In recent years, a large amount of research work has been carried out to prepare high-temperature plastic magnesium alloys by various methods. Some high-temperature plastic magnesium alloys have been reported at home and abroad successively. The patent No. CN101381831A discloses a high-plasticity magnesium alloy which contains 80 to 83% of magnesium, 12 to 15% of zinc, 2 to 8% of zirconium, 23 to 27% by mass of lithium, 7 to 9% by total mass of manganese and 4 to 6% by total mass of yttrium. The alloy prepared by smelting, thermal treatment and extrusion has a room-temperature elongation rate of 42 to 49%. However, the alloy contains a large amount of lithium, so that vacuuming or argon gas protection is needed during the smelting, and the oxygen content is strictly controlled. On the other hand, the alloy contains a large amount of rare earth elements: yttrium and lithium, which makes the alloy expensive. The patent No. CN102925771A discloses a high-room-temperature-plasticity magnesium alloy material and a preparation method thereof, and the alloy material contains 1.0 to 5.0% by mass of Li, 2.5 to 3.5% by mass of Al, 0.7 to 1.3% by mass of Zn, 0.2 to 0.5% by mass of Mn, less than or equal to 0.3% of impurities and the balance of magnesium. The alloy obtained by smelting under conditions of further vacuuming the pure lithium and the AZ31 magnesium alloy in the formula and feeding inert gas has a room-temperature elongation rate of 14 to 31%. Similarly, the alloy smelting process is complicated and the overall room-temperature elongation rate is still low. The patent No. CN102061414A discloses a high-plasticity magnesium alloy and a preparation method thereof. The alloy is prepared from 0.5 to 2% of Al, 2% of Mn, 0.02 to 0.1% of Ca and the balance of magnesium, and has a room-temperature elongation rate up to 25%. Although the cost of the alloy of the present disclosure is low, the elongation rate is still low.

The room-temperature plasticity of these disclosures with high-room-temperature-plasticity is still low. In order to better meet the requirements of the various industries for low cost, ease of processing and high performance of high-strength magnesium alloys, there is an urgent need for developing magnesium alloy materials with excellent room-temperature plasticity by applying simple production processes, which will greatly exploit the advantage of rich magnesium reserve volume resources in China and has significant national economic and social significance.

SUMMARY

The present disclosure relates to the field of metal materials and metal material processing, and more particularly relates to a plastic deformable magnesium alloy and a preparation method thereof. The novel magnesium alloy may be used as a potential heat-resistant magnesium alloy and a biomedical magnesium alloy material.

Mainly aiming at the problems of extremely high cost, complicated process, etc. of an existing high-room-temperature-plasticity magnesium alloy caused by a large use amount of various rare earth elements or high-price alloying elements or adoption of special processing and large plastic deformation measures, the present disclosure provides a low-cost trace rare earth high-room-temperature-plasticity magnesium alloy and a preparation method thereof. The alloy is a novel Mg—Al—Bi—Sn—Ca—Y alloy, and a high-room-temperature-plasticity wrought magnesium alloy may be obtained by simple processing measures and has a room-temperature elongation rate of 32% or more. Meanwhile, the raw materials and processing are low in cost, and large batch production is easy to realize.

The technical solution of the present disclosure is that: a plastic wrought magnesium alloy, namely a Mg—Al—Bi—Sn—Ca—Y alloy, prepared from the following chemical components in percentage by mass: 3 to 6.0% of Al, 1 to 3.0% of Bi, 0.5 to 2.0% of Sn, 0.02 to 0.05% of Ca, 0.02 to 0.05% of Y and the balance of Mg and inevitable impurities, in which the percentage sum of Ca and Y elements is more than 0.05% and less than 0.1%.

A preparation method of a plastic wrought magnesium alloy includes the following steps:

1) performing mixing: mixing a pure Mg ingot, a pure Al block, a pure Bi block, a pure Sn block, a Mg—Ca intermediate alloy and a Mg—Y intermediate alloy which serve as raw materials according to the magnesium alloy composition;

2) performing smelting: putting the pure Mg ingot into a crucible of a smelting furnace, setting a furnace temperature at 700 to 730° C., maintaining the temperature, and respectively adding the pure Bi block and the pure Sn block which are preheated to 50 to 80° C., and the pure Al block, the Mg—Ca intermediate alloy and the Mg—Y intermediate alloy which are preheated to 200 to 250° C. into the magnesium melt after the pure Mg ingot is melted; then increasing the smelting temperature to 750° C., and maintaining the temperature for 5 to 15 minutes, then stirring the mixture for 3 to 10 minutes, feeding high-purity Ar gas for refining and degassing treatment, and adjusting and controlling the temperature at 710 to 730° C. and maintaining the temperature for 2 to 10 minutes, in which the smelting process is performed under the protection of CO2/SF6 mixed gas;

3) performing casting: removing dross from the surface of the melt, and pouring the magnesium alloy melt into a corresponding mold to obtain an as-cast magnesium alloy, in which the casting process does not require gas protection;

4) performing solution treatment: performing a solution treatment process by maintaining a temperature of 400 to 415° C. for 16 to 36 hours, then maintaining a temperature of 440 to 460° C. for 6 to 12 hours, and quenching the alloy with warm water of 40 to 80° C., in which the heating and heat preservation processes of the solution treatment do not require gas protection;

5) cutting a cast ingot subjected to the solution treatment in the previous step into a corresponding blank, and peeling the blank; and 6) performing extrusion deformation: heating the blank obtained in the previous step to 250 to 300° C. within 30 minutes, putting the blank into the mold for deformation processing at an extrusion speed of 0.01 to 2 m/min, and cooling the deformed blank in air to finally obtain the plastic magnesium alloy material.

The mold is a mold for forming a bar, a plate, a pipe, a line or a profile.

The stirring in the step 2) is mechanical stirring or stirring via argon blowing.

The Mg—Ca intermediate alloy is a Mg-20Ca intermediate alloy.

The Mg—Y intermediate alloy is a Mg-30Y intermediate alloy.

The volume ratio of components of the $CO_2/SF_6$ mixed gas is $CO_2:SF_6$=(50-100):1.

The substantial characteristics of the present disclosure are that: the room-temperature plasticity of the magnesium alloy may be generally improved by refining grains, regulating and controlling the amounts and sizes of the precipitation-enhanced phases in the alloy, optimizing alloy textures and the like.

The magnesium alloy of the present disclosure takes Al element, Bi element and Sn element as main alloying elements, generates a $Mg_{17}Al_{12}$ phase, a $Mg_3Bi_2$ phase and a $Mg_2Sn$ phase in situ with magnesium in the alloy, and suppresses over growth of the $Mg_{17}Al_{12}$ phase, the $Mg_3Bi_2$ phase and the $Mg_2Sn$ phase by the assistance of trace Ca and Y elements, which enables the most of the Bi element, the Sn element and the Al element to be dissolved into a matrix by thermal treatment, thereby improving the plastic deformation capacity of the alloy.

The present disclosure adopts extrusion processing under process conditions of relatively low temperature and relatively low speed. In this process, a trace amount of residual micron-sized $Mg_3Bi_2$ phase which is not dissolved into the matrix promotes the alloy to undergo dynamic recrystallization nucleation in the form of particle excited nucleation.

Meanwhile, during the extrusion processing under the process conditions of relatively low temperature and relatively low speed, a supersaturated solid solution containing a large amount of Al, Bi and Sn elements will dynamically precipitate a large amount of nano-sized $Mg_{17}Al_{12}$ phase, $Mg_3Bi_2$ phase and $Mg_2Sn$ phase to suppress the growth of recrystallized grains and improve the mechanical properties of the extruded alloy.

In addition, some of the Al, Bi, Sn, Ca and Y elements that are still dissolved in the matrix may improve the alloy texture during the extrusion and avoid the formation of a strong base texture to finally obtain the high-room-temperature-plasticity wrought magnesium alloy material having a room-temperature tensile elongation rate of 32% or more.

Compared with the prior art, the present disclosure has significant progresses and advantages as follows: 1) the magnesium alloy of embodiments of the present disclosure takes the Al element, the Bi element and the Sn element as the main alloying elements and is assisted with the use of trace Ca and Y elements to carry out an alloying process, and most of the Bi element, the Sn element and the Al element are dissolved into the matrix by thermal treatment, thereby improving the plastic deformation capacity of the alloy; in the extrusion processing under the process conditions of relatively low temperature and relatively low speed, a trace amount of residual micron-sized $Mg_3Bi_2$ phase exists stably, which promotes the alloy to undergo dynamic recrystallization nucleation in the form of particle excited nucleation; meanwhile, during the extrusion processing under the process conditions of relatively low temperature and relatively low speed, the supersaturated solid solution containing a large amount of Al, Bi and Sn elements will dynamically precipitate a large amount of nano-sized $Mg_{17}Al_{12}$ phase, $Mg_3Bi_2$ phase and $Mg_2Sn$ phase to suppress the growth of recrystallized grains and improve the mechanical properties of the extruded alloy; in addition, some of the Al, Bi, Sn, Ca and Y elements that are still dissolved in the matrix may improve the alloy texture during the extrusion and avoid the formation of a strong base texture to finally obtain the high-room-temperature-plasticity wrought magnesium alloy material having a room-temperature tensile elongation rate of 32% or more while a current commercial magnesium alloy AZ31 capable of being extruded at a high speed and processed under the same extrusion conditions only has a room-temperature tensile elongation rate of 20.2%;

2) the magnesium alloy of the present disclosure only contains a trace amount of rare earth Y, and the prices of the metals Bi and Sn are low, so that the alloy is low in cost (rare earth is generally 1000 to 5000 yuan per kilogram, and each of the metals Bi and Sn used in this patent is only about 100 yuan per kilogram); the alloy is widely used to produce automotive parts such as window frames and seat frames and may also be extruded into various types of profiles serving as part blanks in the aerospace field;

3) the preparation process of the magnesium alloy of the present disclosure is simple, and breaks through limitations of special processing methods such as large plastic deformation required by most high-strength and high-toughness magnesium alloys, and existing magnesium alloy extrusion equipment may continuously process and produce the alloys without additional improvements and has low requirements for production equipment; and 4) in addition, the alloy of the present disclosure also has a good flame retardant effect and is relatively uniform and stable during smelting; since the melting point (271.3° C.) of the main alloying element Bi and the melting point of the Sn element are relatively low, the alloy melt is easily caused to be uniform; meanwhile, the Ca element and rare earth element are jointly added into the magnesium alloy, so that the magnesium alloy has a relatively good flame retardant effect and the melt is also relatively stable, and the obtained alloy is relatively high in high temperature oxidation resistance; and casting and thermal treatment may be carried out without gas protection under the conditions of the present disclosure.

The present disclosure generates a large amount of $Mg_3Bi_2$ phase, $Mg_2Sn$ phase and $Mg_{17}Al_{12}$ phase by adopting relatively low extrusion temperature and speed, and suppresses over growth of second phases by alloying of trace Ca and Y elements. In addition, the Bi element, the Sn element and the trace Ca and Y elements are simultaneously dissolved into a matrix to improve texture features of the deformed alloy, thereby developing the high-room-temperature-plasticity wrought magnesium alloy having a room-temperature elongation rate reaching 32% or more.

BRIEF DESCRIPTION OF THE DRAWINGS

In order to make the objective, technical solution and advantages of the present disclosure clearer, the present disclosure is further described below in combination with accompanying drawings.

DETAILED DESCRIPTION

Figure 1:
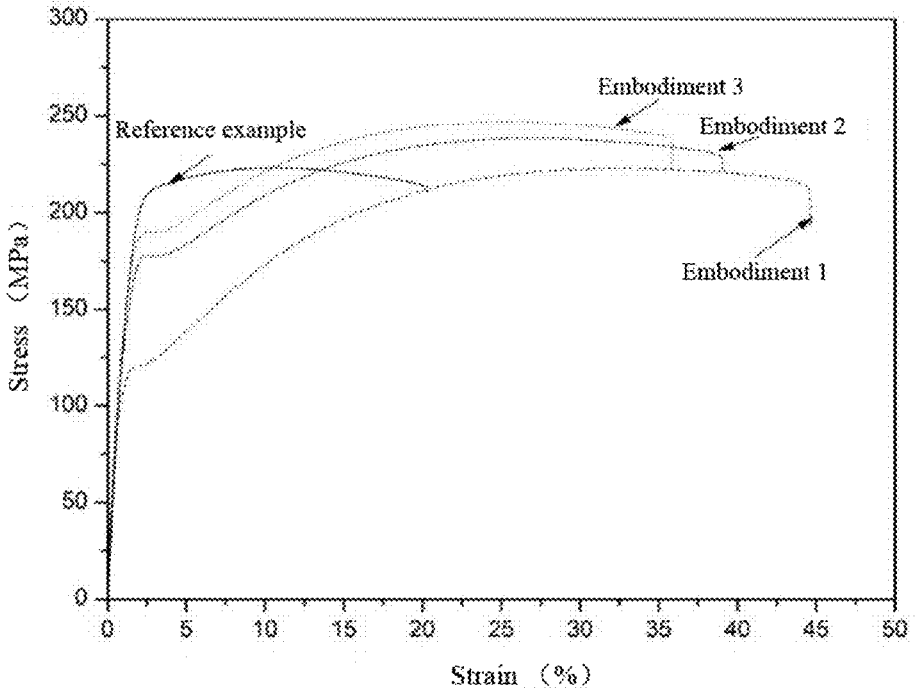
FIG. 1 shows room-temperature tensile test stress-strain curves of magnesium alloys of Embodiments 1, 2 and 3 and a reference example.

The present disclosure is further described below by the specific embodiments and the accompanying drawings. The following embodiments are all implemented on the premise of the technical solution of the present disclosure, and detailed implementation modes and specific operation processes are given, but the protection scope of the present disclosure is not limited to the following embodiments.

Three alloy compositions Mg-3Al-3Bi-1Sn-0.04Ca-0.02Y (wt %) (alloy 1), Mg-4Al-2Bi-1Sn-0.03Ca-0.03Y (wt %) (alloy 2) and Mg-6Al-3Bi-1Sn-0.03Ca-0.05Y (wt %) (alloy 3) are selected as typical examples.

According to the technical solution of the present disclosure, a pure Mg (99.8 wt %) ingot, a pure Al (99.9 wt %) block, a pure Bi (99 wt %) block, a pure Mg (99.5 wt %) block, a Mg-20Ca (actually detected content of Ca is 20.01 wt %) intermediate alloy and a Mg-30Y (actually detected content of Y is 30.02 wt %) intermediate alloy are used as alloying raw materials. The raw materials are smelted into a low-cost magnesium alloy ingot; a blank subjected to solution treatment and peeling treatment is placed in an induction heating furnace and rapidly heated to an extrusion temperature of 260° C.; then, the magnesium alloy blank is deformed into a bar by extrusion processing at an extrusion speed of 1 m/min and an extrusion ratio of 36, and the extruded bar is cooled in air. Meanwhile, the extruded bar is tested for mechanical properties. Test results of the room-temperature mechanical properties of the embodiments and Reference example AZ31 are shown in Table 1.

Embodiment 1: the Mg-3Al-3Bi-1Sn-0.04Ca-0.02Y (wt %) alloy composition is selected and proportioned into a magnesium alloy. The preparation method includes the following steps:

1) mixing is performed: a pure Mg ingot, a pure Al block, a pure Bi block, a pure Sn block, a Mg—Ca intermediate alloy and a Mg—Y intermediate alloy which serve as raw materials are mixed according to the aforementioned target composition;

2) smelting is performed: the pure Mg ingot is put into a crucible of a smelting furnace, a furnace temperature is set at 720° C. and then maintained, and the pure Bi block and the pure Sn block which are preheated to 50° C. and the pure Al block, the Mg-20Ca intermediate alloy and the Mg-30Y intermediate alloy which are preheated to 200° C. are respectively added into the magnesium melt after the pure Mg ingot is melted; then the smelting temperature is increased to 750° C. and maintained for 15 minutes; the mixture is stirred for 5 minutes; high-purity Ar gas is fed for refining and degassing treatment; and the temperature is adjusted and controlled at 720° C. and maintained for 8 minutes, in which the smelting process is performed under the protection of $CO_2/SF_6$ mixed gas;

3) casting is performed: dross is removed from the surface of the melt, and the magnesium alloy melt is poured into a corresponding mold to obtain an as-cast magnesium alloy, in which the casting process requires no gas protection;

4) solution treatment is performed: a solution treatment process is performed by maintaining a temperature of 415° C. for 20 hours, then maintaining a temperature of 440° C. for 8 hours, and quenching the alloy with warm water of 50° C., in which the heating and heat preservation processes of the solution treatment require no gas protection;

5) a cast ingot subjected to the solution treatment in the previous step is cut into a corresponding blank, and the blank is peeled;

6) extrusion deformation is formed: the blank obtained in the previous step is heated to 260° C. within 30 minutes and is put into the mold for deformation processing at an extrusion speed of 1 m/min, and the deformed blank is cooled in air to finally obtain the plastic magnesium alloy material.

Figure 2:
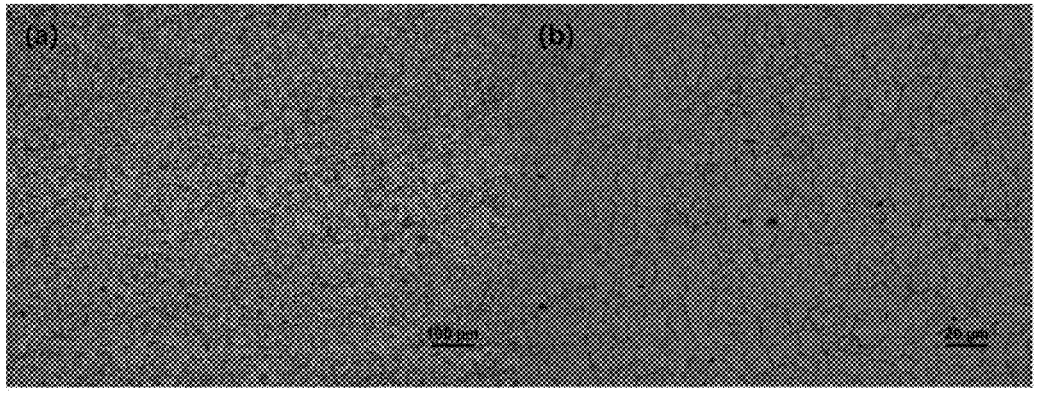
FIG. 2 is a microstructure parallel to an extrusion direction of Embodiment 1.

A test sample having a length of 70 mm is cut off from the extruded magnesium alloy bar obtained in Embodiment 1 and then is processed into a round bar-shaped tensile test sample having a diameter of 5 mm and a gauge length of 32 mm for tensile test, and the axial direction of the test sample round bar is the same as an extrusion flow direction of the material. It is measured that the magnesium alloy of the present disclosure has a tensile strength of 243.5 MPa, a yield strength of 153.7 MPa and an elongation rate of 38.2% as shown in Table 1. The magnesium alloy obtained in this embodiment has both high strength and high elongation rate. The typical tensile curve of the magnesium alloy obtained in this embodiment is shown in FIG. 1. FIG. 2 is a microstructure morphology, parallel to the extrusion direction, of the Mg-3Al-3Bi-1Sn-0.04Ca-0.02Y (wt %) magnesium alloy prepared in the present embodiment. It also can be seen from the metallographic diagram that the alloy undergoes complete dynamic recrystallization during the extrusion, and the grain size is about 15 μm.

Embodiment 2: the Mg-4Al-2Bi-1Sn-0.03Ca-0.03Y (wt %) alloy composition is selected and proportioned into a magnesium alloy. The preparation method includes the following steps:

1) mixing is performed: a pure Mg ingot, a pure Al block, a pure Bi block, a pure Sn block, a Mg—Ca intermediate alloy and a Mg—Y intermediate alloy which serve as raw materials are mixed according to the aforementioned target composition;

2) smelting is performed: the pure Mg ingot is put into a crucible of a smelting furnace, a furnace temperature is set at 720° C. and then maintained, and the pure Bi block and the pure Sn block which are preheated to 50° C. and the pure Al block, the Mg-20Ca intermediate alloy and the Mg-30Y intermediate alloy which are preheated to 200° C. are respectively added into the magnesium melt after the pure Mg ingot is melted; then the smelting temperature is increased to 750° C. and maintained for 15 minutes; the mixture is stirred for 5 minutes; high-purity Ar gas is fed for refining and degassing treatment; and the temperature is adjusted and controlled at 720° C. and maintained for 8 minutes, in which the smelting process is performed under the protection of $CO_2/SF_6$ mixed gas;

3) casting is performed: dross is removed from the surface of the melt, and the magnesium alloy melt is poured into a corresponding mold to obtain an as-cast magnesium alloy, in which the casting process requires no gas protection;

4) solution treatment is performed: a solution treatment process is performed by maintaining a temperature of 415° C. for 20 hours, then maintaining a temperature of 440° C. for 8 hours, and quenching the alloy with warm water of 50° C., in which the heating and heat preservation processes of the solution treatment require no gas protection;

5) a cast ingot subjected to the solution treatment in the previous step is cut into a corresponding blank, and the blank is peeled;

6) extrusion deformation is formed: the blank obtained in the previous step is heated to 260° C. within 30 minutes and is put into the mold for deformation processing at an extrusion speed of 1 m/min, and the deformed blank is cooled in air to finally obtain the plastic magnesium alloy material.

Figure 3:
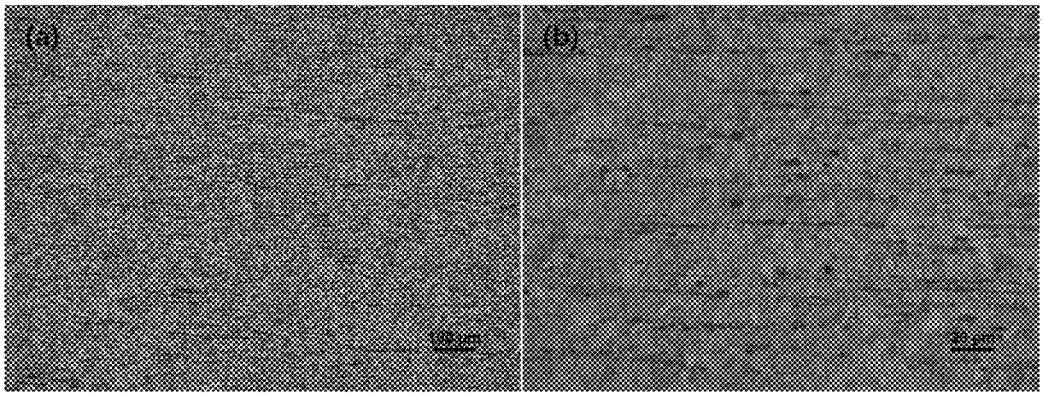
FIG. 3 is a microstructure parallel to an extrusion direction of Embodiment 2.

A test sample having a length of 70 mm is cut off from the extruded magnesium alloy bar obtained in Embodiment 2 and then is processed into a round bar-shaped tensile test sample having a diameter of 5 mm and a gauge length of 32 mm for tensile test, and the axial direction of the test sample round bar is the same as an extrusion flow direction of the material. It is measured that the magnesium alloy of the present disclosure has a tensile strength of 255.3 MPa, a yield strength of 172.4 MPa and an elongation rate of 32.8% (Table 1). The magnesium alloy obtained in this embodiment has both relatively high strength and relatively high elongation rate. The typical tensile curve of the magnesium alloy obtained in this embodiment is shown in FIG. 1. FIG. 3 is a microstructure morphology, parallel to the extrusion direction, of the Mg-4Al-2Bi-1Sn-0.03Ca-0.03Y (wt %) magnesium alloy prepared in the present embodiment. It also can be seen from the metallographic diagram that the alloy undergoes complete dynamic recrystallization during the extrusion, and the grain size is about 10 μm.

Embodiment 3: the Mg-6Al-3Bi-1Sn-0.03Ca-0.05Y (wt %) alloy composition is selected and proportioned into a magnesium alloy. The preparation method includes the following steps:

1) mixing is performed: a pure Mg ingot, a pure Al block, a pure Bi block, a pure Sn block, a Mg—Ca intermediate alloy and a Mg—Y intermediate alloy which serve as raw materials are mixed according to the aforementioned target composition;

2) smelting is performed: the pure Mg ingot is put into a crucible of a smelting furnace, a furnace temperature is set at 720° C. and then maintained, and the pure Bi block and the pure Sn block which are preheated to 50° C. and the pure Al block, the Mg-20Ca intermediate alloy and the Mg-30Y intermediate alloy which are preheated to 200° C. are respectively added into the magnesium melt after the pure Mg ingot is melted; then the melting temperature is increased to 750° C. and maintained for 15 minutes; the mixture is stirred for 5 minutes; high-purity Ar gas is fed for refining and degassing treatment; and the temperature is adjusted and controlled at 720° C. and maintained for 8 minutes, in which the smelting process is performed under the protection of $CO_2/SF_6$ mixed gas;

3) casting is performed: dross is removed from the surface of the melt, and the magnesium alloy melt is poured into a corresponding mold to obtain an as-cast magnesium alloy, in which the casting process requires no gas protection;

4) solution treatment is performed: a solution treatment process is performed by maintaining a temperature of 415° C. for 20 hours, then maintaining a temperature of 440° C. for 8 hours, and quenching the alloy with warm water of 50° C., in which the heating and heat preservation processes of the solution treatment require no gas protection;

5) a cast ingot subjected to the solution treatment in the previous step is cut into a corresponding blank, and the blank is peeled;

6) extrusion deformation is formed: the blank obtained in the previous step is heated to 260° C. within 30 minutes and is put into the mold for deformation processing at an extrusion speed of 1 m/min, and the deformed blank is cooled in air to finally obtain the plastic magnesium alloy material.

Figure 4:
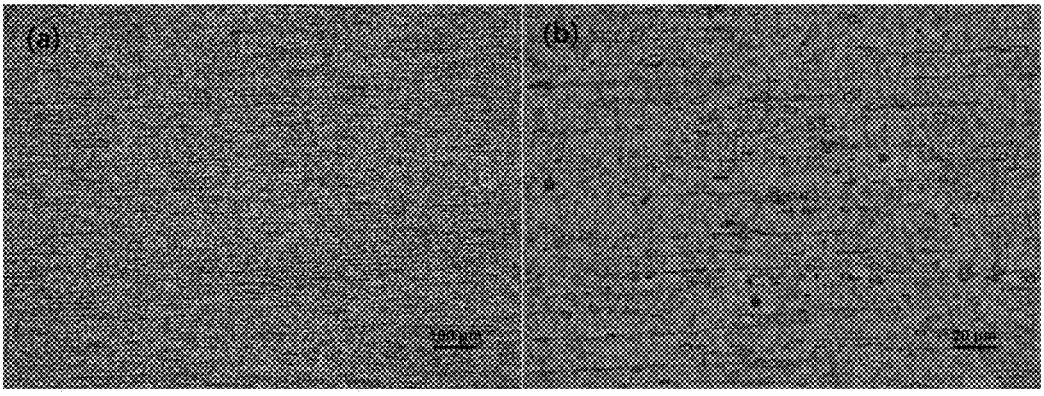
FIG. 4 is a microstructure parallel to an extrusion direction of Embodiment 3.
Figure 5:
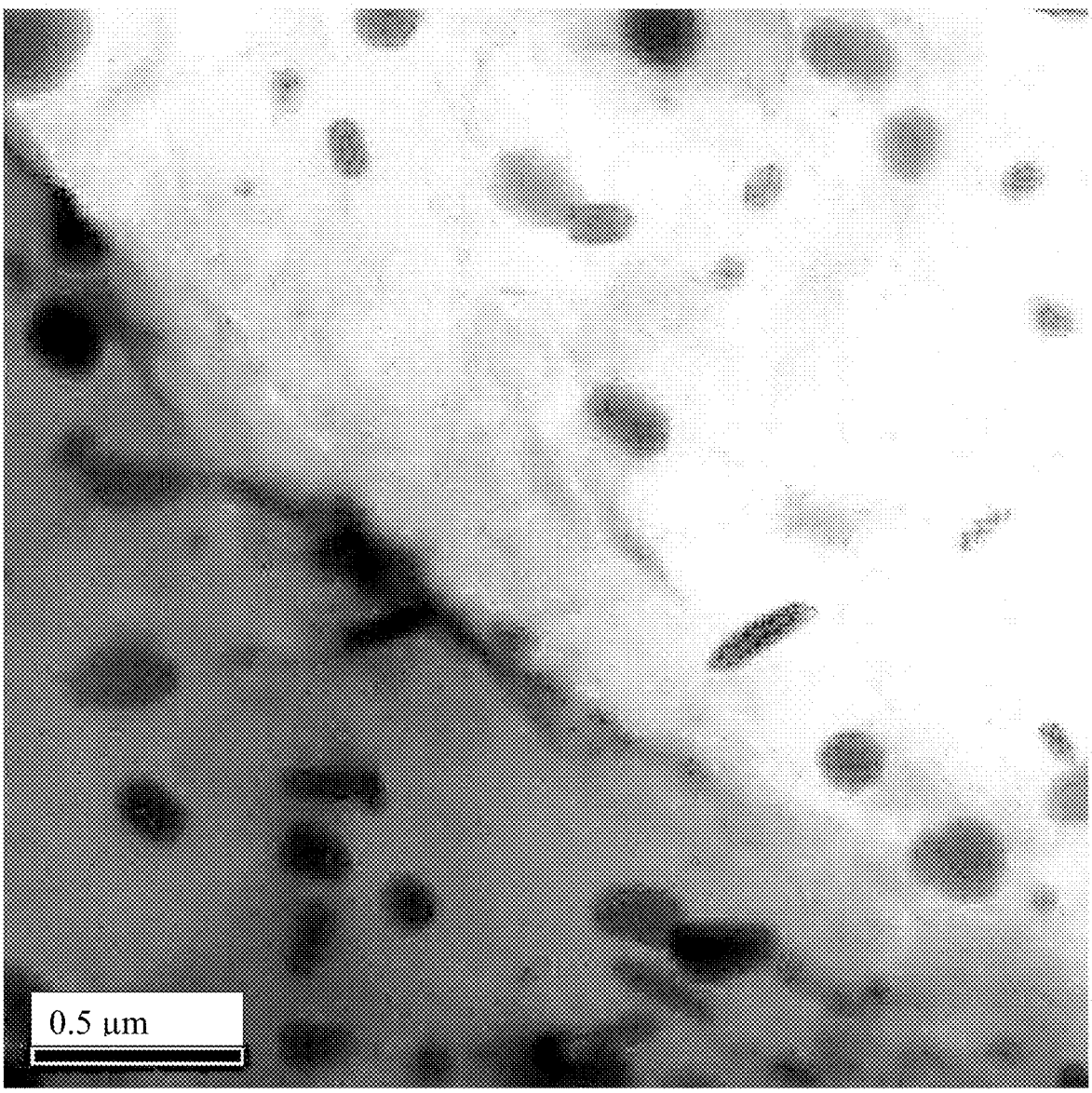
FIG. 5 is a TEM structure of the alloy of Embodiment 3.
Figure 6:
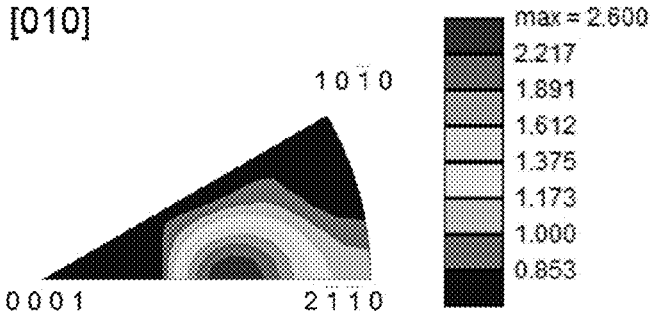
FIG. 6 is an inverse pole diagram of the alloy of Embodiment 3.

A test sample having a length of 70 mm is cut off from the extruded magnesium alloy bar obtained in Embodiment 3 and then is processed into a round bar-shaped tensile test sample having a diameter of 5 mm and a gauge length of 32 mm for tensile test, and the axial direction of the test sample round bar is the same as an extrusion flow direction of the material. It is measured that the magnesium alloy of the present disclosure has a tensile strength of 168.4 MPa, a yield strength of 187.8 MPa and an elongation rate of 32.3%, as shown in Table 1. The magnesium alloy obtained in this embodiment has both relatively high strength and moderate elongation rate. The typical tensile curve of the magnesium alloy obtained in this embodiment is shown in FIG. 1. FIG. 4 is a microstructure morphology, parallel to the extrusion direction, of the Mg-6Al-3Bi-1Sn-0.03Ca-0.05Y (wt %) magnesium alloy prepared in the present embodiment. It also can be seen from the metallographic diagram that the features are similar to those in Embodiment 1 and Embodiment 2, and the alloy undergoes complete dynamic recrystallization during the extrusion, and the grain size is about 8 μm. In addition to the trace micron-sized second phases remaining outside the matrix, a large amount of tiny nano-sized second phases are dispersed in the matrix. FIG. 5 is a TEM structure diagram of the alloy of the embodiment. It can be found that there are many nano-sized precipitated phases in the alloy. These precipitated phases include $Mg_{17}Al_{12}$ phase, $Mg_3Bi_2$ phase and $Mg_2Sn$ phase. These nano-sized precipitated phases may suppress early occurrence of delayed twinning during alloy deformation, thereby improving the room-temperature plasticity of the alloy. FIG. 6 is an inverse pole diagram of the alloy of the embodiment, from which it can be seen that the alloy exhibits a weak non-base texture, thus avoiding the strong base texture and significantly improving the room-temperature plasticity of the alloy.

The reference example is a current commercial AZ31 magnesium alloy: Mg-2.8Al-0.9Zn-0.3Mn (wt %) magnesium alloy. The typical stress-strain curve of the reference example (obtained under the same processing conditions as in Embodiment 2) in the tensile test is shown in FIG. 1. The reference example has a tensile strength of 223.7 MPa, a yield strength of 203.5 MPa and an elongation rate of 20.2%, as shown in Table 1. It can be seen by comparison that the room-temperature strength and elongation rate of the novel magnesium alloy of the present disclosure are significantly improved compared to the alloy of the reference example, thereby achieving similar effects as an alloy subjected to adding of a large number of rare earth elements and large plastic deformation. The novel alloy is a novel low-cost, high-strength and high-toughness magnesium alloy material with extremely high market competitiveness.

The raw materials and equipment used in the aforementioned embodiments are all obtained by publicly known ways, and operation processes used are familiar to those skilled in the art.

TABLE 1

Test results of room-temperature mechanical properties of the Embodiments and the reference example

| Example | Alloy composition (wt %) | Tensile strength MPa | Yield strength MPa | Elongation rate % |
|---|---|---|---|---|
| Embodiment 1 | Mg—3Al—3Bi—1Sn—0.04Ca—0.02Y | 243.5 | 153.7 | 38.2 |
| Embodiment 2 | Mg—4Al—2Bi—1Sn—0.03Ca—0.03Y | 255.3 | 172.4 | 32.8 |
| Embodiment 3 | Mg—6Al—3Bi—1Sn—0.03Ca—0.05Y | 168.4 | 187.8 | 32.3 |
| Reference example | AZ31 | 223.7 | 203.5 | 20.2 |

The invention claimed is:

1. A preparation method of a plastic wrought magnesium alloy, comprising the following steps:

1) performing mixing: mixing a pure Mg ingot, a pure Al block, a pure Bi block, a pure Sn block, a Mg—Ca intermediate alloy and a Mg—Y intermediate alloy which serve as raw materials according to a magnesium alloy composition;
2) performing smelting: putting the pure Mg ingot into a crucible of a smelting furnace, setting a furnace temperature at 700 to 730° C., maintaining the temperature, and respectively adding the pure Bi block and the pure Sn block which are preheated to 50 to 80° C., and the pure Al block, the Mg—Ca intermediate alloy and the Mg—Y intermediate alloy which are preheated to 200 to 250° C. into the magnesium melt after the pure Mg ingot is melted; then increasing the smelting temperature to 750° C., and maintaining the temperature for 5 to 15 minutes, then stirring the mixture for 3 to 10 minutes, feeding Ar gas for refining and degassing treatment, and adjusting and controlling the temperature at 710 to 730° C. and maintaining the temperature for 2 to 10 minutes, wherein the smelting process is performed under the protection of $CO_2/SF_6$ mixed gas;
3) performing casting: removing dross from the surface of the melt, and pouring the magnesium alloy melt into a corresponding mold to obtain an as-cast magnesium alloy, wherein no gas protection is performed during the casting;
4) performing solution treatment: performing a solution treatment process by maintaining a temperature of 400 to 415° C. for 16 to 36 hours, then maintaining a temperature of 440 to 460° C. for 6 to 12 hours, and quenching the alloy with warm water of 40 to 80° C., wherein no gas protection is performed during the heating and heat preservation processes of the solution treatment;
5) cutting a cast ingot subjected to the solution treatment in the previous step into a corresponding blank, and peeling the blank; and
6) performing extrusion deformation: heating the blank obtained in the previous step to 250 to 300° C. within 30 minutes, putting the blank into the mold for deformation processing at an extrusion speed of 0.01 to 2 m/min, and cooling the deformed blank in air to finally obtain the plastic magnesium alloy material.

2. The preparation method of the plastic wrought magnesium alloy according to claim 1, wherein the mold is a mold for forming a bar, a plate, a pipe, a line or a profile.

3. The preparation method of the plastic wrought magnesium alloy according to claim 1, wherein the stirring in the step 2) is mechanical stirring.

4. The preparation method of the plastic wrought magnesium alloy according to claim 1, wherein the stirring in the step 2) is stirring via argon blowing.

5. The preparation method of the plastic wrought magnesium alloy according to claim 1, wherein the Mg—Ca intermediate alloy is a Mg-20Ca intermediate alloy.

6. The preparation method of the plastic wrought magnesium alloy according to claim 1, wherein the Mg—Y intermediate alloy is a Mg-30Y intermediate alloy.

7. The preparation method of the plastic wrought magnesium alloy according to claim 1, wherein the volume ratio of components of the $CO_2/SF_6$ mixed gas is $CO_2$: $SF_6$=(50-100):1.

8. The preparation method of the plastic wrought magnesium alloy according to claim 1, wherein the magnesium alloy composition comprises in percentage by mass: 3 to 6.0% of Al, 1 to 3.0% of Bi, 0.5 to 2.0% of Sn, 0.02 to 0.05% of Ca, 0.02 to 0.05% of Y and a balance of Mg; and the percentage sum of Ca and Y elements is more than 0.05% and less than 0.1%.

* * * * *